US011306453B2

(12) United States Patent
Reinert

(10) Patent No.: US 11,306,453 B2
(45) Date of Patent: Apr. 19, 2022

(54) ONE-PIECE METAL PLATE FOUNDATION WITH INTEGRAL OFFSET PLATE FOR GUARDRAILS AND OTHER STRUCTURES AND GUARDRAIL SYSTEM UTILIZING SAME

(71) Applicant: Safe Foundations Global, LLC., Carnegie, PA (US)

(72) Inventor: Gary L Reinert, Carnegie, PA (US)

(73) Assignee: Gary L. Reinert, Sr., Carnegie, PA (US)

( * ) Notice: Subject to any disclaimer, the term of this patent is extended or adjusted under 35 U.S.C. 154(b) by 821 days.

(21) Appl. No.: 15/837,368

(22) Filed: Dec. 11, 2017

(65) Prior Publication Data

US 2018/0355567 A1 Dec. 13, 2018

Related U.S. Application Data

(63) Continuation of application No. PCT/US2016/037146, filed on Jun. 13, 2016.

(60) Provisional application No. 62/174,100, filed on Jun. 11, 2015.

(51) Int. Cl.
*E01F 15/04* (2006.01)

(52) U.S. Cl.
CPC ..... *E01F 15/0476* (2013.01); *E01F 15/0423* (2013.01); *E01F 15/0461* (2013.01); *E01F 15/0438* (2013.01)

(58) Field of Classification Search
CPC ..... E01F 15/0461; E01F 15/0476; E01F 15/0423; E01F 15/0438; E04H 17/20; E04H 17/22; E04H 17/1447; E04H 17/21
USPC ..... 256/13.1, 65.14, 65.02
See application file for complete search history.

(56) References Cited

U.S. PATENT DOCUMENTS 1,522,739 A * 1/1925 Mohr ..... E04H 17/12 256/58
1,989,763 A * 2/1935 McFarland ..... E01F 15/0461 256/13.1
2,025,014 A * 12/1935 Brickman ..... E01F 15/0438 256/13.1

(Continued)

FOREIGN PATENT DOCUMENTS

CA 2849099 A1 * 3/2013 ..... E04H 12/2215
DE 1784758 B1 * 8/1972 ..... E01F 15/0461

(Continued)

*Primary Examiner* — Josh Skroupa
(74) *Attorney, Agent, or Firm* — Blynn L. Shideler; Krisanne Shideler; BLK Law Group

(57) ABSTRACT

A one-piece metal plate foundation suitable for guardrails and other structures includes a longitudinally extending main plate body; a rear flange extending at an angle from at least a longitudinal portion of the main plate body in a first direction at a rear edge of the main plate body; a front flange extending at an angle from a longitudinal portion of the main plate body in a direction opposite the first direction at a front edge of the main plate body; an integral offset spacing plate coupled to a front edge of the main plate body above the front flange and extending laterally forward of the front flange; and a mounting flange extending at an angle from at least a longitudinal portion of the offset spacing plate at a front edge of the offset spacing plate, wherein the mounting flange is configured for mounting of a guardrail.

20 Claims, 3 Drawing Sheets

(56) References Cited

U.S. PATENT DOCUMENTS 2,942,853 A * 6/1960 Glaros ..... E01F 15/0461 256/13.1
2,979,307 A * 4/1961 Crone ..... E01F 15/0461 256/13.1
3,493,213 A 2/1970 Ackerman
4,222,552 A * 9/1980 Matteo, Sr. ..... E01F 15/0453 248/345.1
4,330,106 A * 5/1982 Chisholm ..... E01F 15/0423 256/13.1
5,152,507 A * 10/1992 Lee ..... E01F 13/026 256/13.1
6,007,269 A * 12/1999 Marinelli ..... E01F 15/0438 256/13.1
6,168,346 B1 1/2001 Ernsberger
6,488,268 B1 * 12/2002 Albritton ..... E01F 15/0461 256/13.1
6,530,560 B2 * 3/2003 King ..... E01F 15/0438 256/1
6,533,249 B2 * 3/2003 Ochoa ..... E01F 15/0423 256/13.1
6,595,715 B1 * 7/2003 Cortell ..... E01F 15/0438 256/13.1
6,644,888 B2 * 11/2003 Ochoa ..... E01F 15/0438 404/6
6,758,627 B2 7/2004 King
6,978,582 B2 * 12/2005 Bernard ..... E01F 15/0461 256/13.1
7,234,687 B2 6/2007 King
8,215,619 B2 7/2012 Leonhardt et al.
8,353,499 B2 1/2013 Conway et al.
8,517,349 B1 * 8/2013 Ross ..... E01F 15/143 256/13.1
8,807,536 B2 8/2014 Conway et al.
8,820,722 B2 * 9/2014 Reinert, Sr. ..... E04H 12/2215 256/65.14
D765,883 S * 9/2016 Jaimes ..... E01F 15/0438 D25/119
10,570,641 B2 * 2/2020 Pavey ..... E04H 17/20
11,091,890 B2 * 8/2021 Bergendahl ..... E01F 15/06
2003/0085394 A1 * 5/2003 Ochoa ..... E01F 15/143 256/13.1
2003/0151038 A1 8/2003 Alberson et al.
2004/0086334 A1 5/2004 Kamarata
2004/0206020 A1 * 10/2004 Stuart ..... E04H 12/2269 52/169.1
2006/0202182 A1 9/2006 Bergendahl et al.
2008/0265231 A1 * 10/2008 King ..... E01F 15/0438 256/13.1
2011/0186795 A1 8/2011 Bianchi
2012/0205603 A1 * 8/2012 Bianchi ..... E01F 15/0461 256/13.1
2012/0211710 A1 8/2012 Leonhardt et al.
2012/0298943 A1 11/2012 Yang
2014/0008594 A1 1/2014 Bianchi
2014/0103278 A1 4/2014 Cai
2014/0110651 A1 4/2014 Cox et al.
2014/0145132 A1 5/2014 Leonhardt et al.
2014/0319441 A1 10/2014 Conway et al.
2016/0145893 A1 * 5/2016 Coulston ..... E04H 17/20 256/59

FOREIGN PATENT DOCUMENTS

EP 2383390 A2 * 11/2011 ..... E01F 15/0438
EP 2628852 A2 * 8/2013 ..... E01F 15/0423

* cited by examiner

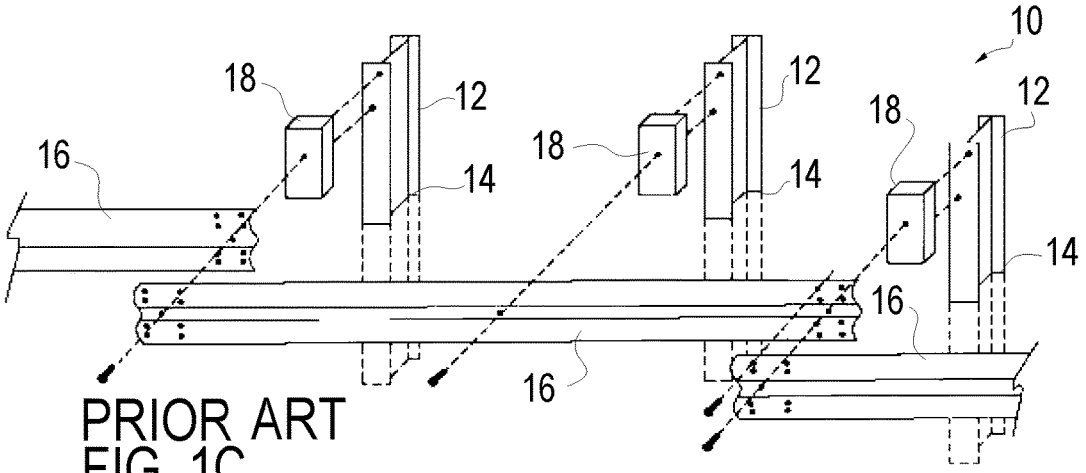
PRIOR ART
FIG. 1C
FIG. 3
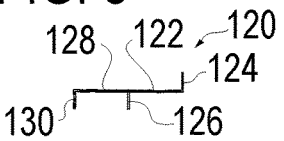
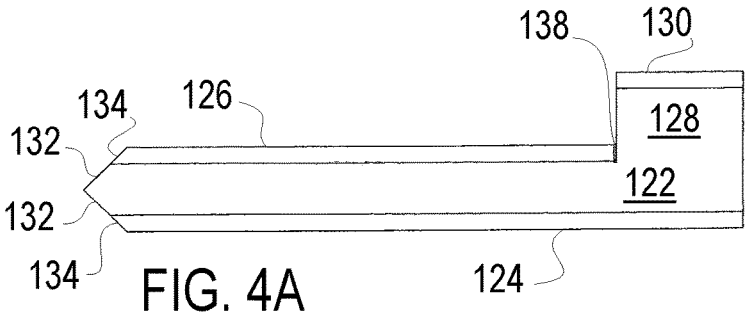
FIG. 4A
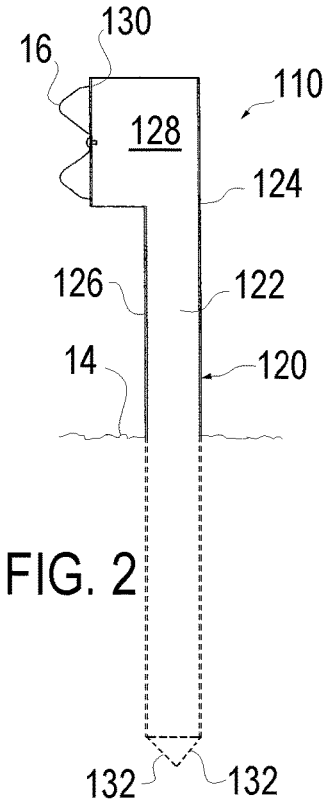
FIG. 2
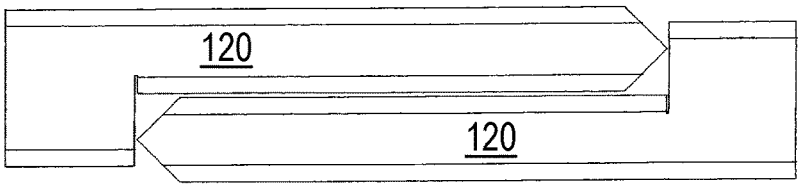
FIG. 4B FIG. 6
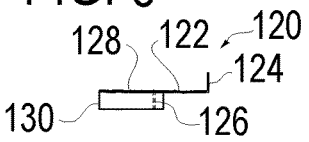
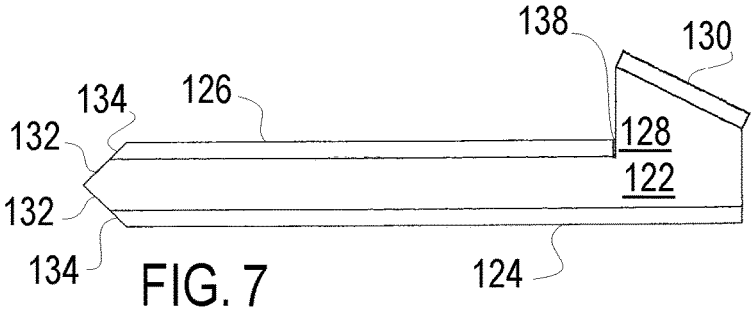
FIG. 7
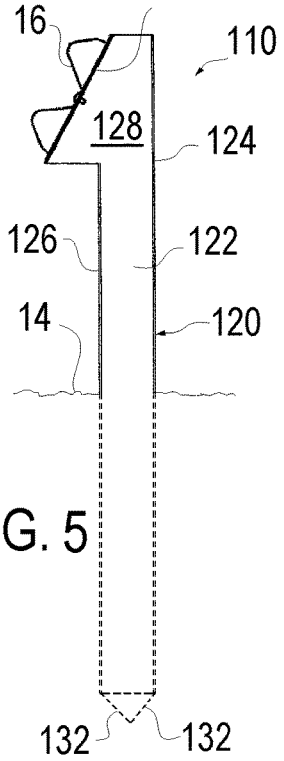
FIG. 5

ONE-PIECE METAL PLATE FOUNDATION WITH INTEGRAL OFFSET PLATE FOR GUARDRAILS AND OTHER STRUCTURES AND GUARDRAIL SYSTEM UTILIZING SAME

RELATED APPLICATIONS

This application is a continuation of International Patent Application Serial Number PCT/US2016/037146, titled "One-piece Metal Plate Foundation with Integral Offset Plate for Guardrails and other Structures and Guardrail Systems Utilizing Same" which published Dec. 15, 2016 as Publication No. WO 2016/201401 and which application and publication are incorporated herein by reference in their entireties.

International Patent Application Serial Number PCT/US2016/037146 claims priority to U.S. Patent Application Ser. No. 62/174,100 filed Jun. 11, 2015, titled "One-piece Metal Plate Foundation with Integral Offset Plate for Guardrails and other Structures and Guardrail Systems Utilizing Same" which application is incorporated herein by reference in its entirety.

BACKGROUND INFORMATION

1. Field of the Invention

The present invention relates to foundations with integral offset plate for guardrails and other structures and guardrail systems utilizing the same.

2. Background Information

Along many roadways it is often hazardous for a vehicle to leave the roadway. As a result, roadway safety barriers, most commonly guardrail systems, are used along roadways. The guardrail systems, also called generically called guiderails, can act to contain and redirect an errant vehicle along such roadways. Such guardrail systems may dissipate some of the vehicle's energy through deformation of the rail or post, or both. Some literature has suggested that the term "guardrail" is inaccurate and inappropriate as the rail does not "guard" and cannot be relied upon to completely guard or restrain a vehicle, and thus the term guiderail is preferred. These arguments seem silly and resulting from an overly litigious society, regardless the terms guiderail and guardrail are used interchangeably herein.

A conventional guardrail system includes a plurality of rails secured to a plurality of support posts made of wood or steel. The rail is a generally horizontal metal member raised above the ground to bumper height extending generally along the guarded roadway, and is also commonly referenced as a guiderail, guardrail and beam. The support posts represent the foundational elements of the system and generally extend vertically. The most common type of rail is the corrugated sheet shown in figures. Other rail configurations such as thrice beams and box beams were also used. Support posts have been most commonly made of wood, metal or a combination of both.

A traditional guardrail system is disclosed in U.S. Pat. No. 3,493,213, which is incorporated herein by reference, and consists of a rail which is attached to supporting posts via a spacer block. The spacer block holds the rail away from its supporting post so as to help prevent snagging of an impacting vehicle's wheels on the posts. Various types of spacer blocks, also called block-outs, spacers, positioning blocks and the like, are commercially available, including wood blocks, steel I-beam sections, and also blocks formed of elastomeric materials, such as is disclosed by U.S. Pat. No. 6,530,560, which is incorporated herein by reference. U.S. Pat. Nos. 6,007,269; 6,168,346; 6,758,627; 7,234,687 also disclose guardrail support posts, attachments and positioning spacer blocks used for positioning of a corrugated guardrail on posts during installation and thereafter.

FIG. 1A illustrates a conventional guiderail system 10 of the prior art using wooden posts 12 placed in the ground (grade) 14 at fixed distances (such as 6 feet). The corrugated guiderail 16 is generally galvanized steel of 2.74 mm-3 mm thick (some manufacturers provide a range of thickness up to 6 mm as desired) and generally in standard lengths and widths, e.g. 12-ft, 6-in steel corrugated rail sections and conforming to set standards, such as Standards: JT/T 281-1995, AASHTO M-180, RAL-RG620, SPS98S, or any other International Standards. Instead of hot dip galvanized, the rail members 16 may be coated with PVC. The corrugated guiderail 16 may be a thrice-beam shape or other desired energy dissipating shape. As noted above the rail 16 is attached to the supporting post 12 via a spacer block or block-out member 18. With wooden posts 12 the member 18 is often temporarily nailed in position during assembly.

Wooden support posts 12 have several drawbacks. Wooden support posts 12 are susceptible to deterioration from environmental exposure. As a result, wooden posts 12 are often treated with certain chemicals to slow deterioration, but such chemical treatments created additional expense in handling and in disposing of the treated wood. Wooden support posts 12 also have been installed within metal foundation sleeves or within concrete foundations, thus adding material costs and labor costs that result in a more expensive installation. Moreover, the same chemicals that aid in prolonging the life of the wooden posts 12 can make the disposal of the posts 12 on replacement a hazardous waste.

The trend has been toward using steel support posts 12, rather than wooden support posts 12, due to savings in material cost, installation costs, durability, reliability, and maintenance. Steel posts 12, also called I-beams, H-beams and W-beams, are typically installed by driving the posts 12 directly into the ground. Steel posts 12 also can be treated to slow the effects of environmental exposure from rust and the like. FIG. 1B illustrates a conventional guiderail system 10 of the prior art using steel posts 12 placed in the ground (grade) 14 at fixed distances (such as 6 feet). The rail 16 is attached to the supporting post 12 via a spacer blocks 18, or block-out members 18. FIG. 1C illustrates a conventional guiderail system 10 of the prior art using steel posts 12 and spacer blocks 18. The separate block out members 18 of the prior art systems 10 will add costs to the overall system 10 and increases the labor in assembly.

For improved safety, break away steel support posts 12 that allow for failure during a collision have been developed. Such break away designs include I-beam posts 12 with cutouts or apertures along a portion of the post 12. Other break away designs had the post 12 in two sections joined with rotatable or releasable couplings that connected the two sections of the post 12 and failed upon a sufficient predesignated impact force. See for reference U.S. Pat. No. 8,215,619 and U.S. Pat. Pub. No. 2012-0211710, which are incorporated herein by reference. However, such prior two piece breakaway steel posts 12 required substantial time, money, and resources during fabrication, modification, and installation.

The state of the art in guardrail systems 10 has been documented and applied through specifications used by the industry. The United States Department of Transportation Federal Highway Administration provides "Standard Specifications for Construction of Roads and Bridges on Federal Highway Projects," including a section for guardrails 16 and support posts 12. Industry groups such as the American Association of State Highway and Transportation Officials AASHTO, the Associated General Contractors (AGC) of America, and the American Road & Transportation Builders Association ARTBA have developed "A Guide to Standardized Highway Barrier Hardware" that included specifications for guardrails 16 and posts 12. These specifications also generally teach a guardrail system 10 having a guardrail 16 bolted to a large wood post 12 or a large w-beam steel post 12. In general, in the past, larger posts 12 in guardrail systems 10 better withstood impact forces to redirect a vehicle along the direction of the roadway.

The patent literature is helpful in illustrating the state of the art of guiderail systems 10 and associated components. U.S. Pat. Nos. 8,807,536 and 8,353,499 and U.S. Pat. Pub. No. 2014-0319441, which are all incorporated herein by reference, all disclose roadway guardrail systems including a rail having a plurality of mounting apertures, a plurality of support posts each having a slot extending along a portion of the length of the post such that upon a vehicle impact with the rail the associated fasteners are adapted to slide along the slot in the support post.

U.S. Pat. Pub. No. 2014-0145132, which is incorporated herein by reference, discloses a guardrail system which includes a guardrail, a support post, and a fastener joining the guardrail and the support post, and a slot for the movement of the fastener during an impact. A fastener retention mechanism retains the fastener in the hole until a predetermined level of force is attained during an impact, after which the fastener is released and moves into the slot.

U.S. Pat. Pub. No. 2014-0110651, which is incorporated herein by reference, discloses guardrail system which includes a plurality of posts spaced apart along a longitudinal direction and a plurality of rail sections extending between and coupled to the spaced apart posts, and a cable extending along the longitudinal direction which is coupled to the rail sections and/or posts and is vertically spaced above the uppermost surface of the rail sections.

U.S. Pat. Pub. No. 2014-0103278, which is incorporated herein by reference, discloses a guardrail system which is used for a highway, wherein, a guardrail is formed by PVC resin and has reinforcing bands fixed therein.

U.S. Pat. Pub. Nos. 2014-0008594, 2012-0205603, and 2011-0186795, are incorporated herein by reference, disclose a highway guardrail post (or foundation) which comprises an elongated one-piece roll-formed metal body including a front wall defining an attachment face, a pair of opposing side walls orthogonal to the front wall, a first pair of inverted corners respectively connecting the pair of side walls to the front wall, and a second pair of inverted corners respectively extending from the pair of side walls and terminating in a pair of spaced rear edges to define a rear access opening opposite the front wall. The guardrail posts may be manufactured by roll-forming a metal sheet or coil and cutting the roll-formed metal sheet or coil into lengths.

U.S. Pat. Pub. No. 2012-0298943, which is incorporated herein by reference, discloses a highway guardrail post or foundation formed as a metal jacket composite post.

U.S. Pat. Pub. No. 2006-0202182, which is incorporated herein by reference, discloses a guardrail system having a plurality of vertical support posts supporting a plurality of guardrail beams. Block-outs, also called spacer herein, are disclosed as being mounted between the guardrail beams and the posts to offset the posts from the guardrail beams. Separately, cable supporting posts are also disclosed.

U.S. Pat. Pub. No. 2004-0086334, which is incorporated herein by reference, discloses a highway guardrail post formed as a laminated structure.

U.S. Pat. Pub. No. 2003-0151038, which is incorporated herein by reference, discloses a guardrail support post that includes a continuous structural member having first and second generally parallel flanges, and a web forming a coupling between, and extending generally perpendicular to the first and second flanges. The first and second flanges include first and second cutouts, respectively, that occur within the mid portion and are operable to weaken the structural member about an axis generally perpendicular to the flanges without substantially weakening the structural member about an axis generally parallel to the flanges.

U.S. Pat. Pub. No. 2003-0085394, which is incorporated herein by reference, discloses a guardrail system having a plurality of vertical support posts supporting a plurality of guardrail beams. Each post includes a pair of flanges having free edge portions with edge folds defining tubular beads on the free edge portions to provide reinforcement and desired to utilize a minimum amount of material usage for the posts. Block-outs, also called spacer herein, are disclosed as being mounted between the guardrail beams and the posts to offset the posts from the guardrail beams.

There remains a need for a cost effective, efficient, foundations or support posts for roadway guardrails and similar structures.

SUMMARY OF THE INVENTION

This invention is directed to a cost effective, efficient, foundation or support post for roadway guardrails and guardrail systems formed utilizing the same. The terms foundation and support post are used generally interchangeably herein. Technically, the foundation is the portion of the post structure below the grade while the support post is the above grade portion (with the integrated offset block or plate of the invention). Additionally, direction is helpful for describing the foundations of the present invention. The top of the foundation is the end above ground while the bottom is the end of the foundation below ground. The rear is the side away from the rail mount, generally away from the roadway in guardrail system applications; and the front is the side of the rail mount, generally facing the roadway in guardrail system applications. Within the meaning of this application, the longitudinal direction of the posts or foundations is generally along a top-bottom axis while a lateral direction of the posts or foundations is generally along a rear-front axis.

One aspect of the present invention provides a one-piece metal plate foundation, or support post, suitable for guardrails and other structures which includes a main plate body that extends the longitudinal length of the foundation from a top to a bottom of the foundation; a rear flange extending at an angle from at least a longitudinal portion of the main plate body in a first direction at a rear edge of the main plate body; a front flange extending at an angle from a longitudinal portion of the main plate body in a direction opposite the first direction at a front edge of the main plate body; an integral offset block spacing plate coupled to a front edge of the main plate body above the front flange and extending laterally forward of the front flange; and a mounting flange extending at an angle from at least a longitudinal portion of the offset block spacing plate at a front edge of the offset spacing plate, wherein the mounting flange is configured for mounting of a guardrail.

Another aspect of the present invention provides a guardrail system comprising: a plurality of guardrail supporting posts, each post including i) a main plate body extending the longitudinal length of the foundation from a top to a bottom of the foundation; ii) a rear flange extending at an angle from at least a longitudinal portion of the main plate body in a first direction at a rear edge of the main plate body; iii) a front flange extending at an angle from a longitudinal portion of the main plate body in a direction opposite the first direction at a front edge of the main plate body; iv) an integral offset block spacing plate coupled to a front edge of the main plate body above the front flange and extending laterally forward of the front flange; and v) a mounting flange extending at an angle from at least a longitudinal portion of the offset block spacing plate at a front edge of the offset spacing plate; and at least one guardrail section secured to each mounting flange of each guardrail supporting post.

One aspect of the present invention provides a one-piece plate foundation comprising: a main plate body extending the longitudinal length of the foundation from a top to a bottom of the foundation; a rear flange extending from at least a longitudinal portion of the main plate body in a first direction at a rear edge of the main plate body; a front flange extending at an angle from a longitudinal portion of the main plate body in a direction opposite the first direction at a front edge of the main plate body, wherein the front flange is substantially parallel to the rear flange; an integral offset spacing plate coupled to a front edge of the main plate body above the front flange and extending laterally forward of the front flange; and a mounting flange extending at an angle from at least a longitudinal portion of the offset spacing plate at a front edge of the offset spacing plate.

These and other aspects of the present invention will be clarified in the description of the preferred embodiment of the present invention described below in connection with the attached figures in which like reference numerals represent like elements throughout.

BRIEF DESCRIPTION OF THE DRAWINGS

FIGS. 1A-C are schematic exploded perspective views of conventional commercial prior art guardrail systems;

FIG. 2 is a side elevation view of a guardrail system utilizing a one-piece metal plate foundation with integral offset plate according to one embodiment of the present invention;

FIG. 3 is a top plan view of the one-piece metal plate foundation with integral offset plate used in the guardrail system shown in FIG. 2;

FIG. 4A is a top plan view of a cut plate used to form the one-piece metal plate foundation with integral offset plate shown in FIGS. 2 and 3;

FIG. 4B is a top plan view of a layout for a pair of cut plates used to form two of the one-piece metal plate foundations with integral offset plates shown in FIGS. 2 and 3.

FIG. 5 is a side elevation view of a one-piece metal plate foundation with integral offset plate according to another embodiment of the present invention;

FIG. 6 is a top plan view of the one-piece metal plate foundation with integral offset plate shown in FIG. 5; and FIG. 7 is a top plan view of a cut plate used to form the one-piece metal plate foundation with integral offset plate shown in FIGS. 5 and 6.

BRIEF DESCRIPTION OF THE PREFERRED EMBODIMENTS

Figure 1A:
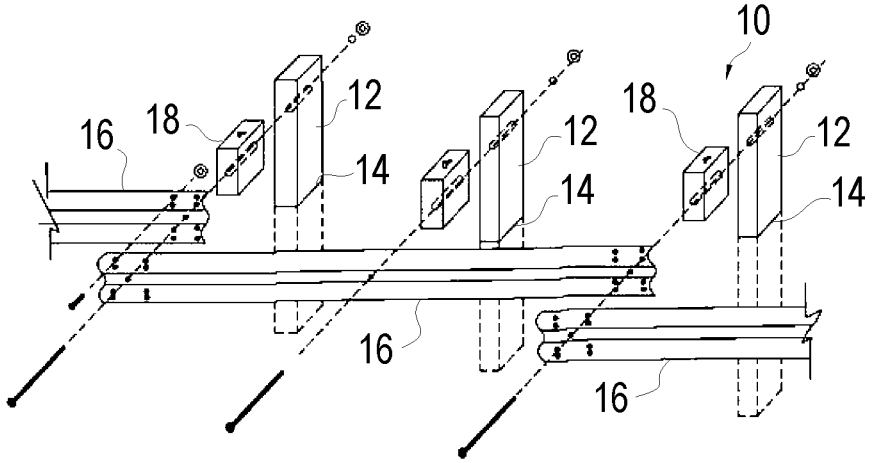
PRIOR ART FIG. 1A
Figure 1B:
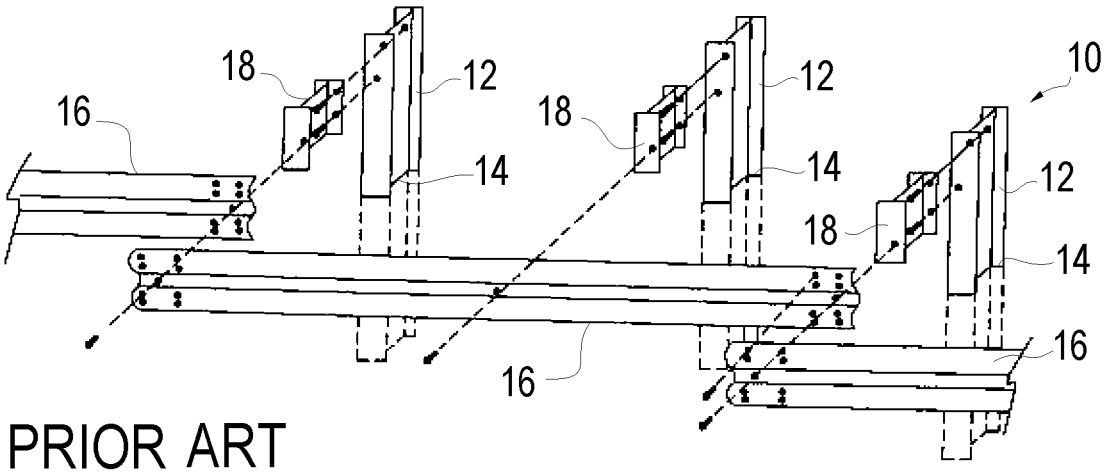
PRIOR ART FIG. 1B

FIG. 2 is a side elevation view of a guardrail system 110 utilizing a one-piece metal plate foundation or post 120 with integral offset plate 128 according to one embodiment of the present invention. The roadway guardrail system 110 as presently disclosed will generally dissipate a portion of an impacting vehicle's energy and enable an impacting vehicle to be redirected by the system 110. The roadway guardrail system 110 may be installed adjacent a roadway, such as along median strips, roadway shoulders, or any other path that is likely to encounter vehicular traffic.

The guardrail system 110 includes plurality of guardrail supporting posts 120 spaced conventionally along a roadside or other desired location. Each post 120 includes i) a main plate body 122 extending the longitudinal length of the foundation from a top to a bottom of the foundation; ii) a rear flange 124 extending at an angle from at least a longitudinal portion of the main plate body in a first direction at a rear edge of the main plate body; iii) a front flange 126 extending at an angle from a longitudinal portion of the main plate body in a direction opposite the first direction at a front edge of the main plate body; iv) an integral offset spacing plate 128 coupled to a front edge of the main plate body 122 above the front flange 126 and extending laterally forward of the front flange 126; and v) a mounting flange 130 extending at an angle from at least a longitudinal portion of the offset spacing plate 128 at a front edge of the offset spacing plate 128.

The guardrail system 110 includes least one guardrail section 16 secured to each mounting flange 130 of each guardrail supporting post 120. The guiderail system 110 is analogous to the prior art in that the posts 120 are placed in the ground (or grade) 14 at fixed distances (such as 6 feet). The corrugated guiderail 16 is generally galvanized steel of 2.74 mm-3 mm thick, or thicker is desired for particular applications, and generally in standard lengths and widths, e.g. 12-ft, 6-in steel corrugated rail sections 16 and conforming to set standards, such as Standards: JT/T 281-1995, AASHTO M-180, RAL-RG620, SPS98S, or any other International Standards. Instead of hot dip galvanized, the rail sections 16 may be coated with PVC. The guiderail 16 may also be a thrice-beam (or sometimes called a thrie-beam) shape or other known desired energy dissipating shape. The rail sections 16 may be sliced together along the guardrail system 110 in the same manner as the prior art guardrail systems 10 and coupled to the posts 120 using the same fasteners as rail sections 16 are coupled to the I-beam posts 12 of the prior art.

The installation and repair of the guardrail system 110 of the present invention yields a significant labor savings over the guardrail systems 10 of the prior art in that only the rail members 16 need to be aligned with the mounting flanges 130 of posts 120 rather than the prior art need to align the spacer block 18 with the post 12 (then perform a sub-assembly step) and then align the rail members 16 with the spacer block 18.

The key feature of the guardrail system 110 is the cost effective, efficient, foundation or support post 120. The terms foundation and support post are used generally interchangeably herein of the foundation 120. As noted above, it is often proper to mention that the foundation is the portion of the structure of the post 120 below the grade 14 while the "support post" is the above grade portion of the post 120. Additionally, direction is helpful for describing the foundations 120 of the present invention. The top of the foundation 120 is the end above ground 14 while the bottom is the beveled end (bevel portions 132 and 134) of the foundation 120 below ground 14. The rear of foundation 120 is the side away from the rail mount or mounting flange 128, generally away from the roadway in guardrail system 110 applications. The front of the foundation 120 is the side of or with the mounting flange 130, generally facing the roadway in guardrail system 110 applications. Within the meaning of this application, the longitudinal direction of the posts or foundations 120 is generally along a top-bottom axis while a lateral direction of the posts or foundations 120 is generally along a rear-front axis. The foundation 120 is designed for guardrail systems 110 but is not limited to this use. The foundations 120 provide convenient, efficient and effective foundations for mounting other structures, such as solar panel arrays, power transmission structures, and other structures.

Finally it should be noted that the orientations are slightly different when discussing the manufacturing of the foundations 120 which are formed from cut plate, typically steel plate (cut by plasma cutters, laser cutters, hydraulic water jets or the like) that generally lie in a horizontal position when being cut or formed. In manufacturing, the foundations 120 are formed from cut flat plate panels as shown in FIGS. 4A and B in which the flanges 124, 126 and 130 are bent "up" or "down" with hydraulic presses or brakes. Thus FIG. 4A is a "top plan" view of a cut plate used to form the one-piece metal plate foundation 120 with integral offset plate 128 shown in FIGS. 2 and 3, and FIG. 4B is a "top plan" view of a layout for a pair of cut plates used to form two of the one-piece metal plate foundations 120 with integral offset plates 128 shown in FIGS. 2 and 3. In manufacturing it is relevant to note that a groove or slot 138 is formed between the front flange 126 and the offset plate 128 to allow the front flange 126 to be bent into position. FIG. 4B illustrates the material saving arrangement of two foundations 120 on a single plate thereby minimizing scrap during manufacturing. The details of the cutting such as with a plasma cutter and the bending with a hydraulic brake are known in the art. The use of flat steel plate that is bent into shape allows for a wide variety of relatively inexpensive steel plate panels to be used to form the foundations 120. Further the use of simply hydraulic brakes in manufacturing is less expensive than a series of roll bending forms used in some of the proposed rolled channel posts of the prior art and less expensive than the method of forming I-beam or w-beam type posts. Further the foundation 120 of the present invention will utilize less steel than a comparable I-beam or w-beam post 12 of the prior art.

The main plate body 122 of the foundation 120 extends the longitudinal length of the foundation 120 from the top to the bottom of the foundation 120. The bottom of the main plate body 122 may have bevels 132 extending laterally across to assist in the installation of the foundation 120 as it is driven into the ground 14. Additionally the bottom end of the main plate body 122 may be sharpened or beveled across the thickness to assist in installation. The lateral distance (or width) front to rear of the main plate body 122 will be designed to accommodate the necessary strength requirements of the post 120, but typically will be the similar widths of the webbing in I-beam or w-beam shaped posts 12 of the prior art. The longitudinal length of the main plate body 122 will be the same as the overall longitudinal length of the post 120 and will also be designed to accommodate the necessary strength requirements of the post 120, and may vary depending upon soil type, but typically will be of analogous lengths of I-beam or w-beam shaped posts 12 of the prior art. The thickness of the main plate body 122 is the thickness of the plate used to form the post 120, and as noted above the use of a flat plate to form the post 120 allows for a wide variety of plate sizes (thicknesses) to be utilized as desired. If desired the main plate body 122 may include apertures to form a break-away structures.

The foundation 120 includes a rear flange 124 extending at an angle, generally perpendicular, to the main plate body 120 in a first direction at a rear edge of the main plate body. Generally the rear flange 124 will be parallel to but extending in opposite directions from the mounting flange 130 and the front flange 126, as shown in FIG. 3. This parallel mounting of flanges 124, 126 and 130 will generally align with the direction of the rail sections 16. The rear flange 124 of the foundation 120 extends the longitudinal length of the foundation 120 from the top to the bottom of the foundation 120 along the main plate body 122. The bottom of the rear flange 124 also has a bevel 134 extending laterally across the flange to assist in the installation of the foundation 120 as it is driven into the ground 14. Additionally the bottom end of the rear flange 124 may be sharpened or beveled across the thickness to assist in installation. The width of the rear flange 124 (from the rear edge of the main plate body 122 to the distal end of the flange 124) will be designed to accommodate the necessary strength requirements of the post 120, but typically will be the similar widths of the flanges in I-beam shaped posts 12 of the prior art. The longitudinal length of the rear flange 124 will be the same as the overall longitudinal length of the post 120. The thickness of the rear flange 124 is the thickness of the plate used to form the post 120.

The foundation 120 includes a front flange 126 extending at an angle generally perpendicular, to the main plate body 120 in a direction opposite the first direction of the rear flange 124, at a front edge of the main plate body 124. As noted above, generally the front flange 126 will be parallel to the mounting flange 130 and the rear flange 124, as shown in FIG. 3, and generally align with the direction of the rail sections 16. The front flange 126 of the foundation 120 extends from the bottom of the foundation 120 along the main plate body 122 to the slot 138 adjacent the offset 128. The bottom of the front flange 126 also has a bevel 134 extending laterally across the flange 126 to assist in the installation of the foundation 120 as it is driven into the ground 14. Additionally the bottom end of the front flange 126 may be sharpened or beveled across the thickness to assist in installation. The width of the front flange 126, from the front edge of the main plate body 122 to the distal end of the flange 126, will be designed to accommodate the necessary strength requirements of the post 120, but typically will be the similar widths of the flanges in I-beam shaped posts 12 of the prior art. The longitudinal length of the front flange 126 will be less than the overall longitudinal length of the post 120 by the longitudinal length of offset 128 and slot 138. The thickness of the front flange 126 is the thickness of the plate used to form the post 120.

The foundation 120 includes an integral offset spacing plate 128 coupled to a front edge of the main plate body 122 above the front flange 126 and extending laterally forward of the front flange 126. Generally the integral offset spacing plate 128 will be co-planar with the main plate body 122 and generally perpendicular to the mounting flange 130, the front flange and the rear flange 124, as shown in FIG. 3, and generally perpendicular with the direction of the rail sections 16. The integral offset spacing plate 128 of the foundation 120 extends from the top of the foundation 120 along the main plate body 122 to the slot 138 adjacent the front flange 126. The lateral distance of the integral offset spacing plate 128, from the front edge of the main plate body 122 to the flange 130, will be designed to accommodate the necessary offset of the rail 16 from the lower portions of the post 120, but typically will be the similar lengths of blocks 18 of the prior art. The longitudinal length of the integral offset spacing plate 128 will be from the top of the foundation 120 to the slot 138. The thickness of the integral offset spacing plate 128 is the thickness of the plate used to form the post 120.

The post 120 includes the mounting flange 130 extending at an angle from at least a longitudinal portion of the offset spacing plate 128 at a front edge of the offset spacing plate 128. As noted above, generally the mounting flange 130 will be parallel to the front flange 126 and the rear flange 124, as shown in FIG. 3, and generally align with the direction of the rail sections 16. The mounting flange 130 of the foundation 120 extends from the top of the foundation 120 along the offset plate 128 to the slot 138. The width of the mounting flange 130, from the front edge of the offset plate 128 to the distal end of the flange 130, will be designed to accommodate the necessary strength requirements of the mounting of rail 16 to the post 120, but typically will be the similar widths of the flanges in I-beam shaped posts 12 of the prior art. The longitudinal length of the mounting flange 130 will be the overall longitudinal length of offset 128. The thickness of the mounting flange 130 is the thickness of the plate used to form the post 120.

The foundation 120 is not limited for use with guardrails. Consider, for example the embodiment of the foundation 120 shown in FIGS. 5-7. FIG. 5 is a side elevation view of a one-piece metal plate foundation 120 with integral offset plate 128 according to another embodiment of the present invention and FIG. 6 is a top plan view of the one-piece metal plate foundation 120 with integral offset plate shown 128 in FIG. 5; and FIG. 7 is a top plan view of a cut plate used to form the one-piece metal plate foundation 120 with integral offset plate 128 shown in FIGS. 5 and 6. The foundation 120 is identical to the foundation 120 discussed above except the angle of the mounting flange 130 relative to vertical. As shown this flange is slanted to be angled relative to vertical as best shown in FIG. 5. The angled mounting flange makes the foundation well suited for other applications, such as for solar panel array foundations. Of course it still can be used for guardrail rail sections 16, as shown, but the possibility of angling the flange 130 to a desired mounting angle greatly increases the versatility of the foundation.

It is apparent that many variations to the present invention may be made without departing from the spirit and scope of the invention. The present invention is defined by the appended claims and equivalents thereto.

What is claimed is:

1. A one-piece metal plate foundation formed from a one piece metal plate, comprising:

A main plate body extending the longitudinal length of the foundation from a top to a bottom of the foundation;

A rear flange extending at an angle from at least a longitudinal portion of the main plate body in a first direction at a rear edge of the main plate body and not extending beyond the main plate body in a direction opposite the first direction;

A front flange extending at an angle from a longitudinal portion of the main plate body in a direction opposite the first direction at a front edge of the main plate body and not extending beyond the main plate body in the first direction;

An integral offset spacing plate extending from the front edge of the main plate body above the front flange and extending laterally forward of the front flange and with no mechanical fasteners coupling the offset spacing plate to the main plate body; and A mounting flange extending at an angle from at least a longitudinal portion of the offset spacing plate at a front edge of the offset spacing plate.

2. The one-piece metal plate foundation according to claim 1 wherein the rear flange and the front flange extend substantially perpendicular to the main plate body.

3. The one-piece metal plate foundation according to claim 2 wherein the offset spacing plate is substantially co-planar with the main plate body.

4. The one-piece metal plate foundation according to claim 3 wherein the mounting flange extends substantially perpendicular to the offset spacing plate and wherein the mounting flange is configured for mounting of a guardrail.

5. The one-piece metal plate foundation according to claim 4 wherein the rear flange extends for the entire longitudinal length of the main plate body.

6. The one-piece metal plate foundation according to claim 5 wherein the mounting flange extends for the entire longitudinal length of the offset spacing plate.

7. The one-piece metal plate foundation according to claim 6 wherein the bottom of the main plate body is beveled.

8. The one-piece metal plate foundation according to claim 7 wherein the bottom of the main plate body is beveled in both a lateral direction of the main plate body and across a thickness of the main plate body.

9. The one-piece metal plate foundation according to claim 7 wherein a bottom of the rear flange and the front flange are beveled.

10. A guardrail system comprising:

A plurality of one-piece guardrail supporting posts, each one-piece post formed from a one piece metal plate and including;

i) A main plate body extending the longitudinal length of the one-piece post from a top to a bottom of the one-piece post;

ii) A single rear flange extending at an angle from at least a longitudinal portion of the main plate body in a first direction at a rear edge of the main plate body and not extending beyond the main plate body in a direction opposite the first direction;

iii) A single front flange extending at an angle from a longitudinal portion of the main plate body in a direction opposite the first direction at a front edge of the main plate body and not extending beyond the main plate body in the first direction;

iv) An integral offset spacing plate extending from the front edge of the main plate body above the front flange and extending laterally forward of the front flange and with no mechanical fasteners coupling the offset spacing plate to the main plate body; and v) A single mounting flange extending at an angle in one direction from at least a longitudinal portion of the offset spacing plate at a front edge of the offset spacing plate and not extending beyond the offset spacing plate in a direction opposite the one direction; and at least one guardrail section secured to each mounting flange of each guardrail supporting post.

11. The guardrail system according to claim 10 wherein in each guardrail supporting post the rear flange and the front flange extend substantially perpendicular to the main plate body.

12. The guardrail system according to claim 11 wherein in each guardrail supporting post the offset spacing plate is substantially co-planar with the main plate body.

13. The guardrail system according to claim 12 wherein in each guardrail supporting post the mounting flange extends substantially perpendicular to the offset spacing plate.

14. The guardrail system according to claim 13 wherein in each guardrail supporting post the rear flange extends for the entire longitudinal length of the main plate body.

15. The guardrail system according to claim 14 wherein in each guardrail supporting post the mounting flange extends for the entire longitudinal length of the offset spacing plate.

16. The guardrail system according to claim 15 wherein in each guardrail supporting post the bottom of the main plate body is beveled.

17. The guardrail system according to claim 16 wherein in each guardrail supporting post the bottom of the main plate body is beveled in both a lateral direction of the main plate body and across a thickness of the main plate body.

18. The guardrail system according to claim 16 wherein in each guardrail supporting post the bottom of the rear flange and the front flange are beveled.

19. A one-piece plate foundation formed from a one piece metal plate and comprising:

A main plate body extending the longitudinal length of the foundation from a top to a bottom of the foundation;

A single rear flange extending from at least a longitudinal portion of the main plate body in a first direction at a rear edge of the main plate body and not extending beyond the main plate body in a direction opposite the first direction;

A single front flange extending at an angle from a longitudinal portion of the main plate body in a direction opposite the first direction at a front edge of the main plate body and not extending beyond the main plate body in the first direction, wherein the front flange is substantially parallel to the rear flange;

An integral offset spacing plate extending from the front edge of the main plate body above the front flange and extending laterally forward of the front flange and with no mechanical fasteners coupling the offset spacing plate to the main plate body; and A single mounting flange extending at an angle in one direction from at least a longitudinal portion of the offset spacing plate at a front edge of the offset spacing plate and not extending beyond the offset spacing plate in a direction opposite the one direction.

20. The one-piece plate foundation according to claim 19 wherein the rear flange and the front flange extend substantially perpendicular to the main plate body, and wherein the mounting flange extends substantially perpendicular to the offset spacing plate and wherein the bottom of the main plate body is beveled.

* * * * *